US007721639B2

(12) United States Patent
Wössner

(10) Patent No.: US 7,721,639 B2
(45) Date of Patent: May 25, 2010

(54) METHODS AND APPARATUS FOR USE IN A LOCKED MACHINE GUN

(75) Inventor: Ernst Wössner, Sulz-Holzhausen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 11/027,934

(22) Filed: Jan. 3, 2005

(65) Prior Publication Data

US 2010/0005956 A1 Jan. 14, 2010

Related U.S. Application Data

(63) Continuation-in-part of application No. PCT/EP03/05927, filed on Jun. 5, 2003.

(30) Foreign Application Priority Data

Jul. 3, 2002 (DE) ..... 102 29 846

(51) Int. Cl.
*F41A 21/00* (2006.01)
*F41A 11/00* (2006.01)
*F41A 3/26* (2006.01)

(52) U.S. Cl. ..... 89/181; 42/14; 42/75.02

(58) Field of Classification Search ..... 42/14–24, 42/75.02, 76.1; 89/160, 170, 180–190
See application file for complete search history.

(56) References Cited

U.S. PATENT DOCUMENTS 1,360,873 A * 11/1920 Bjorgum ..... 89/138
1,648,833 A 11/1927 Vincon
1,744,162 A * 1/1930 Hatcher ..... 89/160
1,925,776 A * 9/1933 Scotti et al. ..... 89/152

(Continued)

FOREIGN PATENT DOCUMENTS

DE 130278 12/1900

(Continued)

OTHER PUBLICATIONS

English Language Translation of IPER, PCT/EP2003/005927, Jul. 29, 2004.

(Continued)

*Primary Examiner*—Troy Chambers
(74) *Attorney, Agent, or Firm*—Hanley, Flight and Zimmerman, LLC

(57) ABSTRACT

Methods and apparatus are disclosed for a locked machine gun that includes a casing, a barrel, a locking breech mechanism, an abutment and a quick change attachment. The locking breech mechanism has at least one locking body. The abutment holds the locking body or locking bodies of the locked breech mechanism. The quick-change attachment is used to facilitate the removal of the barrel and insertion and attachment of a new barrel. A first part of the abutment remains on the casing when the barrel is being changed, and a second part of the abutment is firmly connected to the barrel. The quick-change attachment is equipped to bring about a separation between the first part of the abutment remaining with the casing and the barrel with the second part. Also, the second part of the abutment has a curved section which controls the engagement of the breech mechanism in the abutment when the breech mechanism closes.

7 Claims, 4 Drawing Sheets

U.S. PATENT DOCUMENTS

| | | | | | |
|---|---|---|---|---|---|
| 2,110,165 | A | * | 3/1938 | Moore | 42/75.02 |
| 2,131,716 | A | * | 9/1938 | Browning | 42/75.02 |
| 2,625,766 | A | | 1/1953 | Simpson | |
| 2,789,478 | A | * | 4/1957 | McColl | 89/163 |
| 2,941,449 | A | * | 6/1960 | Reed | 89/185 |
| 3,645,165 | A | * | 2/1972 | Wohlford | 89/11 |
| 3,772,959 | A | | 11/1973 | Tassie | |
| 3,969,983 | A | * | 7/1976 | Zellweger et al. | 89/185 |
| 4,655,118 | A | * | 4/1987 | Bruderer et al. | 89/185 |
| 4,920,855 | A | * | 5/1990 | Waters | 89/172 |
| 5,920,028 | A | | 7/1999 | Guhring et al. | |
| 6,101,919 | A | * | 8/2000 | Murello | 89/188 |
| 6,708,437 | B2 | | 3/2004 | Murello | |

FOREIGN PATENT DOCUMENTS

| | | |
|---|---|---|
| DE | 299713 | 12/1913 |
| EP | 0803698 | 10/1997 |

OTHER PUBLICATIONS

International Preliminary Examination Report-Supplemental Sheet, PCT/EP03/05927.

International Search Report, PCT/EP03/05927, Sep. 16, 2003.

* cited by examiner

METHODS AND APPARATUS FOR USE IN A LOCKED MACHINE GUN

RELATED APPLICATION

This patent is a continuation-in-part of International Patent Application Serial No. PCT/EP2003/005927, filed Jun. 5, 2003, the disclosure of which is incorporated herein by reference.

TECHNICAL FIELD

This disclosure generally relates weapons and, more particularly to methods and apparatus for use in a locked machine gun.

BACKGROUND

A locked machine gun includes locking parts on a breech mechanism and an abutment. These locking parts engage one another before the machine gun fires a shot. As will be readily appreciated, the locking parts are activated by the closing breech mechanism and, therefore, are abruptly subjected to stress. Additionally, the locking parts experience significant wear of tear because a machine gun may fire an extremely high number of rounds (at least some $10^5$ rounds) during its life.

To account for this wear and tear, a conventional machine gun, such as the MG 42, uses an abutment that is coupled to a detachable barrel. When the barrel is worn out, it is scrapped along with the abutment. The movable locking parts that work with the abutment are associated with and coupled to the breech mechanism. Accordingly, these movable parts can be changed together with the breech mechanism and then, if necessary, be individually replaced in the armory.

Thus, the MG 42 has an advantage in that it is possible to change those wearing parts that are subjected to the most stress. On the other hand, a disadvantage is that the abutments are expensive to manufacture and they have to be changed in cases when only the barrel is worn out. Accordingly, there may be many instances in which the abutment is not worn out, but it must be replaced because the barrel of which the abutment is part is worn out. Further, abutment wear is not typically even.

The MG 42 is a recoil-operated gun with a removable barrel. With gas-operated machine guns, a gas piston facilitates the unlocking and loading motions, and the barrel remains rigid during the firing of a round. For this reason, the abutment in gas-operated machine guns is usually designed to be rigid in the casing of the weapon. Consequently, when replacing a worn abutment, the casing parts are also replaced.

Recoil-operated machine guns are also advantageous because it is easy to replace parts during use. If, for example, during the use of the weapon a quartz pebble falls into the abutment during the firing of a round, it is possible that the entire lock will no longer function. In the case of the recoil-operated MG 42, it is sufficient to change the barrel and if necessary the breech in order to make the MG fit for use again. The marksman can perform these activities on site in less than a minute. On the other hand, if a similar quartz pebble falls into the breech of a gas-operated MG, the weapon casing must be completely replaced. This cannot be performed in the field because the marksman of course does not carry a second weapons casing with him.

It is possible to assign the abutment to the barrel with the gas-operated MG, but the above mentioned disadvantages would still exist.

DETAILED DESCRIPTION

Throughout this specification, all directional references, e.g., "front," "rear," "up" etc. are with respect to the machine gun in a horizontal firing position, where the direction of fire is "to the front."

Figure 1:
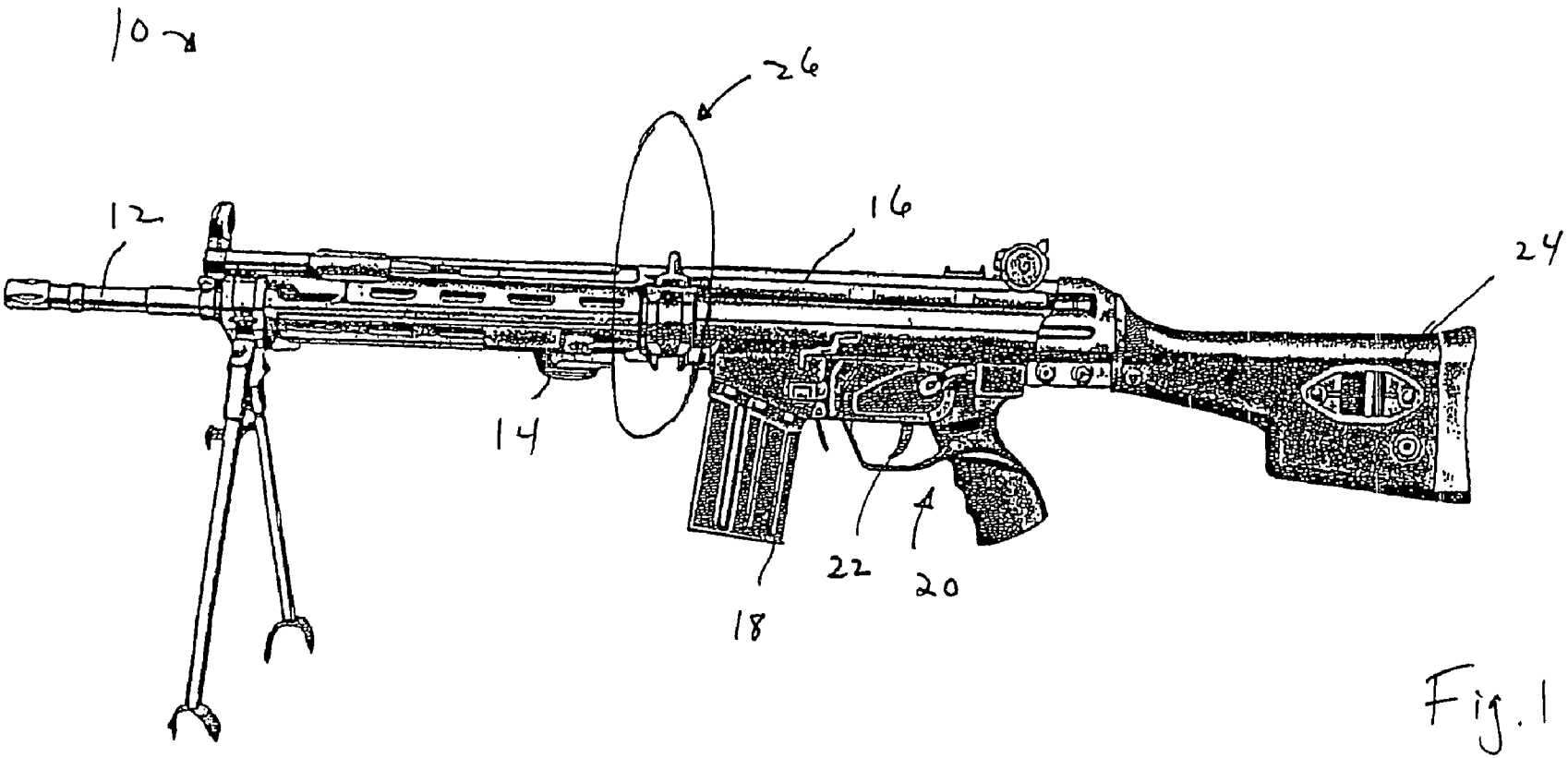
FIG. 1 is a side view of a conventional machine gun.

FIG. 1 shows a conventional, light weight machine gun 10 with a barrel 12, to which a barrel-changing device 14 is connected. The barrel-changing device 14 is the mechanism used to interchangeably hold the barrel 12 in a casing 16. The casing 16 also includes a reloading device 18 such as a magazine, a butt 20 with a trigger 22, and a rear stock 24. A portion of the light weight machine gun 10 at which a rear end of the barrel 12 is located is shown generally at reference numeral 26.

Figure 2:
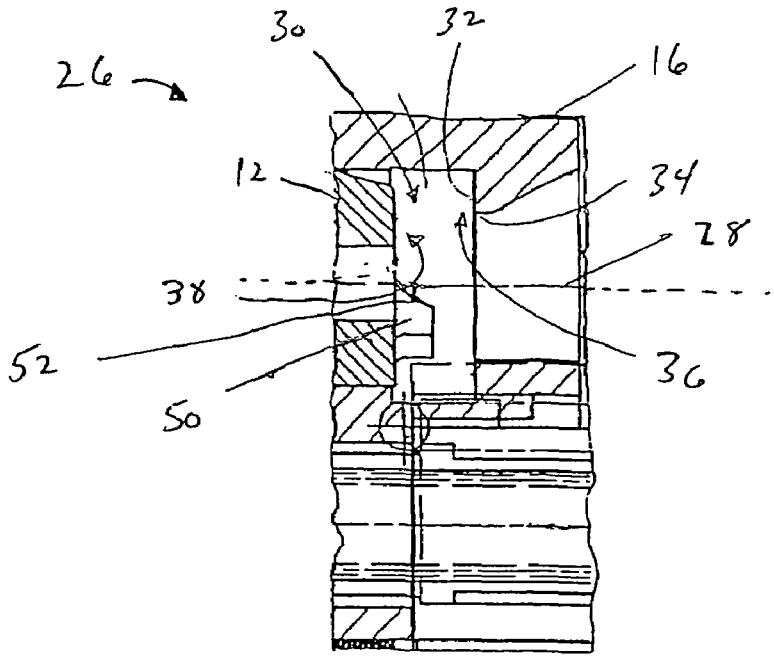
FIG. 2 is a partial longitudinal cross-sectional view through the example machine gun of FIG. 1.

FIG. 2 reveals further detail of the area of FIG. 1 referred to by numeral 26. As shown in FIG. 2, the rear end of the barrel 12 is sectioned on a radial plane adjacent a center line 28 of the barrel 12. Opposite the barrel 12 is the casing 16. When the barrel 12 is inserted into the light weight machine gun 10, an abutment area 30 is formed between the rear end of the barrel 12 and the casing 16, which includes a recess 32 that is open to the front and forms a shoulder 34 to the rear having a smaller diameter than that of the abutment area 30. Accordingly, the rear of the abutment area 30 is defined by a first part 36, which includes the casing 16, and the front of the abutment area 30 is defined by a second part 38 including the barrel 12.

Although not shown in the drawings, the first part 36 includes openings into which a bolt head 44 (described below) can penetrate with two locking pegs 46, 48. After the bolt head 44 is inserted through the openings in the first part 36, the bolt head 44 is rotated to cause the locking pegs 46, 48 to engage the casing 16 to prevent rearward movement of the bolt head with respect to the casing 16 during firing. In particular, the locking peg 48 may engage the shoulder 34.

The barrel 12 includes an extension 50 that protrudes from the rear of the barrel 12. Accordingly, the second part 38 of the abutment 30 includes the extension 50 having a radial cam 52. As described in detail below, the radial cam 52 cooperates with the bolt head 44 to facilitate locking of the bolt head 44 with the casing 16.

Figure 3:
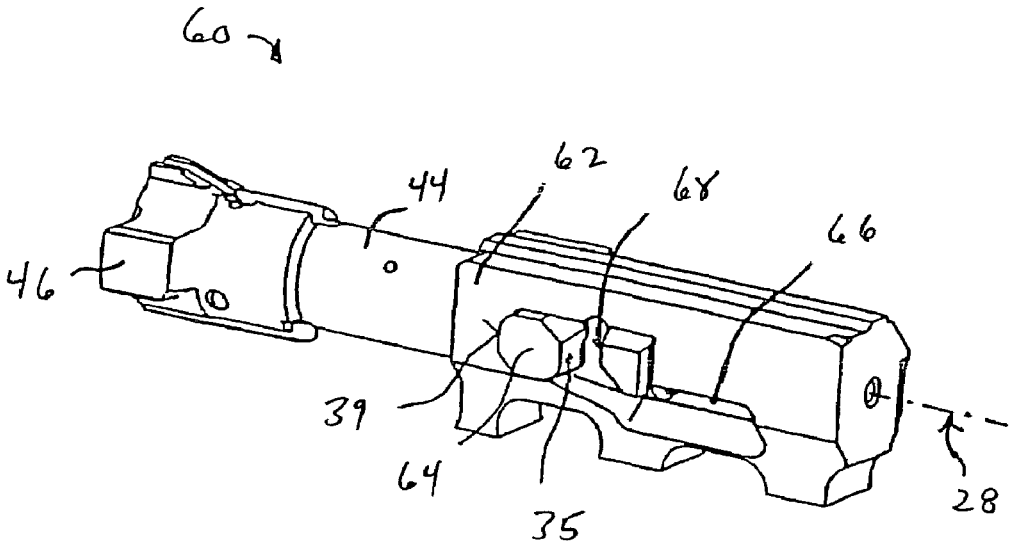
FIG. 3 is front oblique view of the breech mechanism of the machine gun of FIG. 2.
Figure 4:
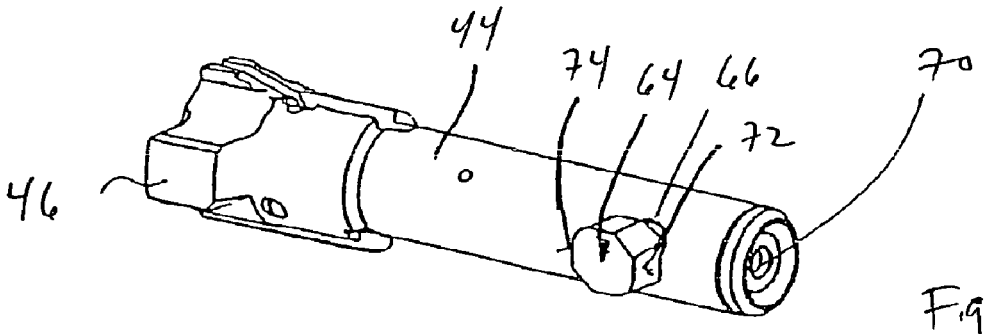
FIG. 4 is a front oblique view of the bolt head of the breech mechanism of FIG. 3.
Figure 6:
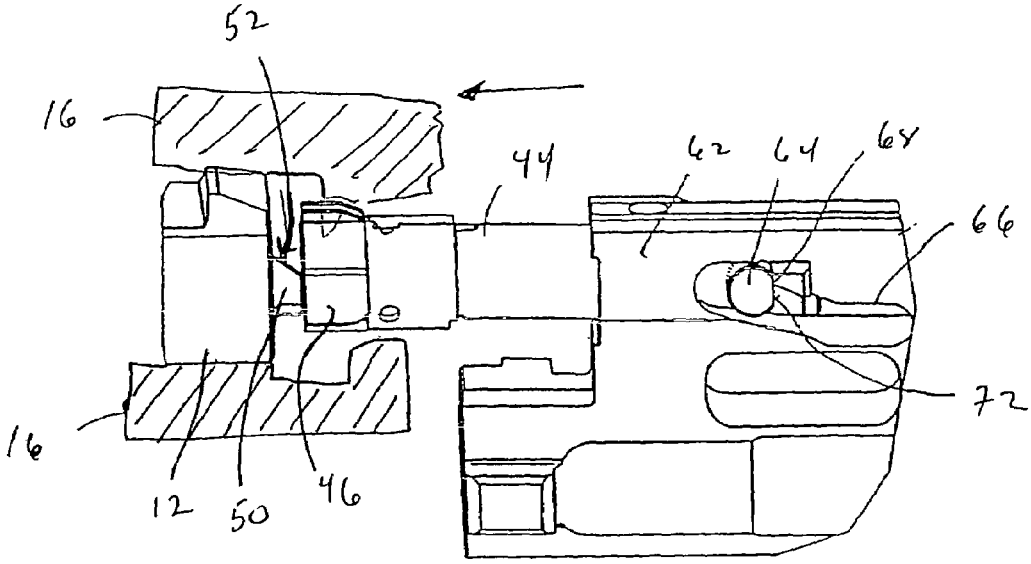
FIG. 6 is a side view of the breech mechanism of FIG. 3 prior to locking.
Figure 7:
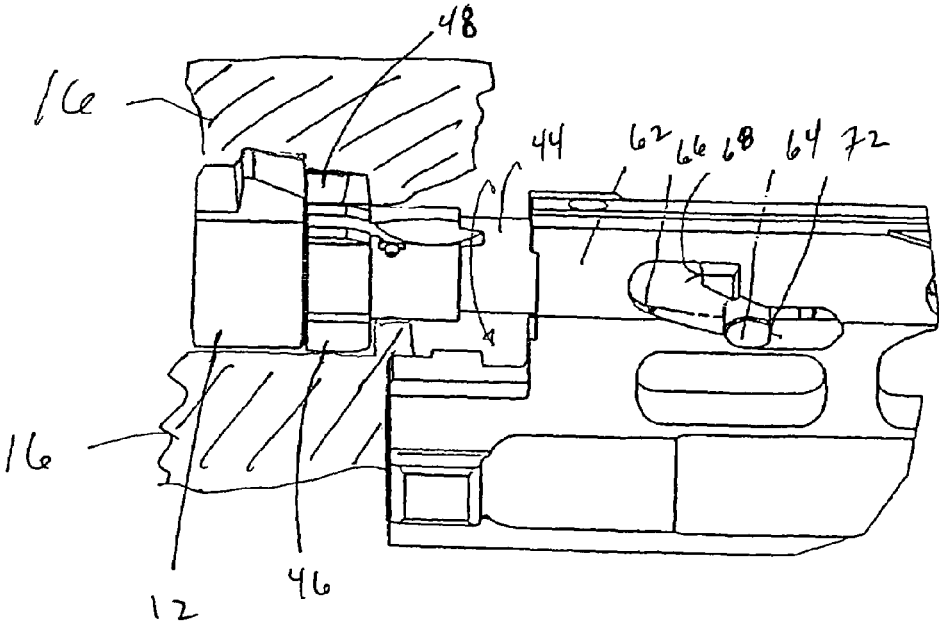
FIG. 7 is a side view of the breech mechanism of FIG. 3 after locking and just prior to firing.

As shown in FIGS. 3, 6, and 7, a breech mechanism 60 includes the bolt head 44 and a bolt head carrier 62. The bolt head carrier 62 is configured for straight-line movement of the bolt head 44 along the center line 28. The bolt head carrier 62 is capable of straight-line movement with respect to the casing 16. The bolt head 44 follows this movement, but rotates around center line 28 during the first phase of the backward movement and in the last phase of the forward movement.

To enable rotation, the bolt head 44 includes a sliding block 64, which extends past the center line 28 into the bolt head 44. The sliding block 64 rides within a crank 66. The bolt head 44 includes a radial bore hole 66 for the purpose of holding said sliding block 64 in its position. The sliding block 64 includes a bore hole 76 to accommodate the firing pin. The bolt head 44 also includes an axial bore hole 70 that is penetrated by the firing pin that lies along the center line 28. For removal of the sliding block 64 the firing pin must first be pulled out to the rear along the center line 28, and then the sliding block 64 must be radially extracted from the bolt head 44 and from the crank 66.

The contour of the crank 66 has, an extended z-shaped figure, with a rear end section, which extends parallel to the direction of the center line 28, and with a middle section extending between the rear end section and a front section. These sections have upper and lower edges, which run generally parallel to one another. The upper and lower edges of the front and middle sections are shaped differently from one another. As shown in the drawings, the lower edge is a straight line in the front and middle sections, which connects to another straight line forming the lower edge of the rear section. The upper edge of the rear section extends parallel to the center line 28. The upper edge of the middle section includes a transitional surface 68, which extends at a right angle to the center line 28. In other words, the transitional surface is substantially vertically oriented.

Complementary to the transitional surface 68, the sliding block 64 includes a flat surface 72 at its rear side. This flat surface 72 extends at a right angle to the direction of the center line 28. When the flat surface 72 rests on the transitional surface 68, as in the case of an open breech mechanism, as shown in FIG. 6, there is no transfer of any transverse force of the bolt head carrier 62 on the bolt head 44 or vice versa, because this force would act vertically to the surfaces 68, 72. In this open breech state, the bolt head 44 does not tend to rotate, and therefore also does not stress the guide formations in the casing in transverse direction. Even when the interior of the casing becomes dirty, which can easily happen when a machine gun is held ready to fire over a longer period of time, there is little resistance on the closing breech mechanism. In particular, there is little friction in the guide formations (grooves and/or rails). Accordingly, the light weight machine gun 10 functions perfectly even when heavily soiled, and the wear and tear is kept as low as possible.

Figure 5:
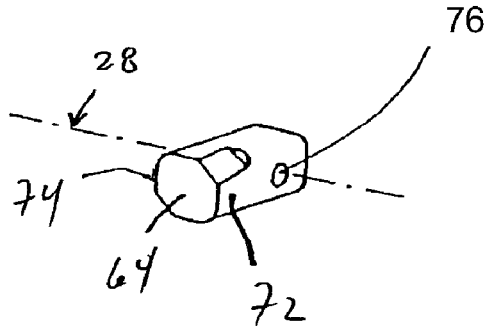
FIG. 5 is a perspective view of the locking block of the breech mechanism of FIG. 3.

The sliding block 64 may be configured to have a second surface 74 that is parallel to and opposite the first surface 72. If surface 72 is worn out, the sliding block 64, as described in connection with FIG. 5, may be removed, turned 180° about its own longitudinal axis and reinserted. Now the new, not yet worn out surface 74 points to the rear and assumes the task of the worn out surface 72.

Certain aspects of the operation of the light weight machine gun 10 are now described in conjunction with FIGS. 6 and 7. As shown in FIG. 6, the carrier 62 and the bolt head 44 are being forced toward the barrel 12 by a spring (not shown). As described above, the barrel 12 includes the extension 50 having the radial cam 52. Accordingly, shortly before reaching the transverse plane at the rear end of the barrel 12 and right after running into the abutment 30, the locking peg 48 (hidden in FIG. 6) engages the radial cam 52 and the bolt head 44 is rotated counter-clockwise. As the bolt head 44 is locked into place, the sliding block 64 rotates counter-clockwise, thereby moving the flat surface 72 downward from the transitional surface 68, causing the bolt head 44 to move rearward. In the locking process the locking pegs 46, 48 engage the first part 36 of the abutment 30, and the bolt head 44 runs into the transverse plane of the barrel 12. The middle and rear sections of the crank 66 act on the sliding block 64 in such a way that the bolt head 44 is exactly rotated to facilitate the engagement. The moment of the shot is shown in FIG. 7.

During the shot the bolt head carrier 62, propelled by a gas piston, recoils from it position shown in FIG. 7, without first rotating the bolt head 44. An example recoil mechanism is described in U.S. patent application Ser. No. 11/027,935, which is incorporated herein by reference. At this point, the locking pegs 46, 48 are engaged with the first part 36 of the abutment 30 and keep the bolt head 44 locked against the barrel 12. As the bolt head carrier 62 moves rearward and the bolt head 44 is locked in place, the sliding block rotates clockwise from its position in FIG. 7, thereby rotating the bolt head 44 clockwise and disengaging the locking pegs 46, 48 from the first part 36 of the abutment 30 and allowing the breech mechanism 60 to move rearwardly. This returns the bolt head 44 back into the position of FIG. 6.

After the light weight machine gun 10 has been fired and the barrel 12 is hot, the hot barrel 12 is replaced with a cold barrel 12. In the barrel replacement process, the extension 50 of the second part 38 of the abutment 30, and hence the radial cam 52, are also replaced. If the radial cam 50 of the hot barrel 12 is damaged or soiled, the barrel 12 can be scrapped or the radial cam 50 can be cleaned after it has cooled off.

If easily replaceable wearing parts are provided, they can be matched in hardness and material quality to the opposite surfaces in such a way that the opposite surfaces are not worn out or are worn out significantly less than the wearing surfaces.

One of ordinary skill in the art would appreciate the improvement the illustrated example makes over the prior art. In particular, the exchangeable barrel should be as economical as possible in light of all the causes of wear and tear. Also replacing the breech mechanism should be avoided. The prior art (e.g., EP-803 698) provides for a separation of the abutment, which simplifies the manufacture of the weapon. This is especially important in the usage of modern, small-caliber cartridges where the weapon components are considerably reduced in size and require greater finishing accuracy. When separating the abutment it is no longer necessary to use thin end mills to go through openings in the receptacle or in the casing to reach the reference surfaces of the abutment that are to be milled. Rather the reference surfaces are easily accessible, can be easily milled and polished, and have their measurements checked. Also, verification of the measurements is important because it makes the work of the weapons mechanic in the unit easier and more precise.

As discussed above, the front part of the abutment, which is associated with the barrel, bears great loads when the breech mechanism closes under the dynamic effect of the breech closing spring. Additionally, with machine guns, the breech mechanism is open in the ready-to-fire state until the trigger is pressed. Once the trigger is pressed, the breech mechanism closes, takes a cartridge from the magazine or belt, puts the cartridge into the cartridge chamber and fires it. As a result of the breech mechanism remaining in the rear and open position as long as there is a cartridge in the weapon and the weapon is not currently being fired, the machine gun is very easily and likely to become dirty. This dirt is pushed forward by the breech mechanism and can, under unfortunate circumstances reach the guide curve of the abutment, where it causes increased damage and wear.

One of ordinary skill in the art would appreciate that the illustrated example improves over the prior art with the use of a curved or cammed section 52 in the second part 38 of the abutment 30, which controls the engagement of the breech mechanism in the abutment 30 when said breech mechanism closes. The greatest surface pressure takes place on this curved section 52. Also, in accordance with the illustrated example, this curved section 52 is located on the barrel 12 and is distant from its rear side. If wear and tear takes place there, then the marksman can easily recognize scoring in the curved section 50 when changing the barrel 12 and then have the curved section 50 scrapped with the associated barrel 12.

One of ordinary skill in the art would appreciate that the illustrated example can be used with breech mechanisms that have locking rollers. However, the illustrated example is particularly useful with a breech mechanism which has a straight-line movable bolt head carrier 62, a rotating bolt head 44 located in the bolt head carrier 62 and a device for rotating the bolt head 44. In such an arrangement, the bolt head 44 engages the first part 36 of the abutment 30 during rotation, and the bolt head 44 can be rotated by running into the second part 38 of the abutment 30 forming the curved section 50. The abutment 30 of breech mechanisms with pivotally arranged bolt heads is difficult to manufacture, unless it is separated as described above. However, there is another advantage: the abutment 30 is relieved of all the work of rotating the bolt head 44 because the radial cam 52, which forms the second part 38 of the abutment 30 and is associated with the barrel 12, assumes that duty.

In the shown example of a machine gun with a rotating breech mechanism, a sliding block 64 is located laterally on the bolt head 44, which engages in a crank 66 on the bolt head carrier 62. As the breech mechanism closes and the bolt head 44 locks, the sliding block 64 lies on a transverse plane of the crank 66, which extends at a right angle to the direction of motion of the breech mechanism 60. Thus, the locking of the bolt head 44 in the abutment 30 is triggered exclusively by the second part 38 of the abutment 30 that has the curved section 52. This greatly reduces wear on the breech mechanism 60, because the crank 66 no longer has to provide for the locking. While it is difficult to close the breech mechanism noiselessly, with machine guns this is not a concern since the round is triggered with the closing of the breech mechanism.

One of ordinary skill in the art would appreciate that the illustrated example is improved by the fact that the sliding block 64 with a guide surface lies at random on the transverse plane of the crank 66. This prevents concentrated load or strip load from occurring in the moment of the greatest load on the sliding block 64 and on the guide surface of the crank 66.

It is further appreciable to one of ordinary skill in the art that the sliding block 64 can be attached in any way in the breech mechanism 64. According to one example, it is inserted laterally into the bolt head 44 and then held by the firing pin. Accordingly, the firing pin facilitates the convenient and rapid interchangeability of the sliding block 64, when it is worn out.

One of ordinary skill in the art would recognize the ease with which the surface 72 of the sliding block 64 can be replaced. The sliding block 64 has a second surface 74 opposite the surface 72. When the surface 72 needs to be replaced, the firing pin is removed and the sliding block 64 is extracted from the bolt head 44. The sliding block 64 is then rotated 180° and reinserted into the bolt head 44 so that the surface 74 is now in the position once occupied by the surface 72. Basically, a sliding block 64 is created which in the case of wear and tear is easily removed, turned over and used again, namely on the part of its surface that had been unused up to then.

Although certain example methods and apparatus have been described herein, this patent covers all methods, apparatus and articles of manufacture fairly falling within the scope of the appended claims either literally or under the doctrine of equivalents.

What is claimed is:

1. An apparatus for use with a locked machine gun comprising:

a casing including a first abutment part;

a barrel including a second abutment part firmly connected to the barrel, wherein the second abutment part includes a curved section extending from the barrel toward a breech opening:

a locking breech mechanism comprising a breech carrier and a breach head including a locking body for engagement with the first abutment part, wherein the breech head engages the curved section of the second abutment part to rotate the locking body into engagement with the first abutment part when a breech of the locked machine gun is closed, thereby locking the locking body with the first abutment part to substantially prevent rearward movement of the breach head relative to the casing during firing; and a quick-change attachment for removal of the barrel and the attachment of a new barrel, wherein the quick-change attachment rotationally fixes the barrel during firing and loading, wherein the quick-change attachment is equipped to bring about a separation between the first abutment part and the second abutment part and wherein when the barrel is replaced with the new barrel the first abutment part remains on the casing.

2. The apparatus as defined in claim 1, wherein the breech carrier comprises a straight-line movable breech head carrier, and wherein the breech head comprises a rotating bolt head partially positioned with the breech head carrier and a device for rotating the bolt head and wherein the locking body engages the first abutment part during rotation of the bolt head and the bolt head rotation is caused by the curved section of the second abutment part.

3. The apparatus as defined in claim 2, further comprising a sliding block located laterally on the bolt head that engages a crank on the breech head carrier, wherein during the closing and locking of the bolt head the sliding block lies on a transverse plane of the crank, which extends at a right angle to the direction of motion of the locking breech mechanism so that the locking of the locking body in the first abutment is triggered exclusively by the curved section of the second abutment part.

4. The apparatus as defined in claim 3, wherein the sliding block includes a guide surface that lies at random on the transverse plane of the crank.

5. The apparatus as defined in claim 4, wherein the sliding block is inserted laterally into the bolt head and is retained by a firing pin.

6. The apparatus as defined in claim 5, wherein the sliding block has, opposite the guide surface, a second guide surface, which after removal of the firing pin, extraction of the sliding block from the bolt head, rotating of the sliding block by 180°, re-insertion of the sliding block into the bolt head and renewed insert ion of the firing pin lies at random on the transverse plane of the crank.

7. An apparatus for use with a locked machine gun comprising:

a casing including a first abutment part, wherein the first abutment part comprises:

a shoulder having a retaining portion, wherein the shoulder defines a first slot and a recess;

a barrel comprising:

a second abutment part positioned on an end of the barrel; and a cam formed on a portion of the second abutment part and extending toward a breech of the locked machine gun;

a locking breech mechanism, comprising:

a breech carrier including a second slot having a transitional surface, wherein the breech carrier moves relative to the casing during at least a portion of unloading the locked machine gun;

a breach head that moves relative to the first slot and is at least partially positioned within the first slot during at least a portion of unloading the locked machine gun, wherein the breach head comprises:

a bolt head;

a locking body disposed at an end of the bolt head for engagement with the retaining portion within the recess to substantially close the breech of the locked machine gun, wherein an interaction between the locking body and the cam rotates the locking body to be adjacent the retaining portion when the breech is closed to lock the locking body with the first abutment part to substantially prevent rearward movement of the breach head relative to the casing; and a sliding block coupled to the bolt head, wherein the sliding block is at least partially positioned within the second slot of the breech carrier, wherein an interaction between the sliding block and the transitional surface of the breech carrier rotates the breech head relative to the first abutment part to unlock the locking body from the first abutment part during at least a portion of unloading the locked machine gun;

a quick-change attachment for removal of the barrel and the attachment of a new barrel, wherein the quick-change attachment rotationally fixes the barrel during firing and loading the locked machine gun, wherein the quick-change attachment is equipped to bring about a separation between the first abutment part and the second abutment part and wherein when the barrel is replaced with the new barrel the first abutment part remains on the casing.

* * * * *

UNITED STATES PATENT AND TRADEMARK OFFICE

CERTIFICATE OF CORRECTION

PATENT NO. : 7,721,639 B2
APPLICATION NO. : 11/027934
DATED : May 25, 2010
INVENTOR(S) : Ernst Wössner It is certified that error appears in the above-identified patent and that said Letters Patent is hereby corrected as shown below:

Column 6, line 34 (Claim 2): Replace "with" with --within--

Column 6, line 59 (Claim 6): Replace "insert ion" with --insertion--

Signed and Sealed this

Seventeenth Day of August, 2010

David J. Kappos

David J. Kappos
*Director of the United States Patent and Trademark Office*